US005884690A

United States Patent [19]

Zussman et al.

[11] Patent Number: 5,884,690

[45] Date of Patent: Mar. 23, 1999

[54] HEATER COVER APPARATUS

[76] Inventors: Peter E. Zussman, 9 Alderwood Dr., North Easton, Mass. 02356; Edward M. Duggan, Jr., 54 Meetinghouse La., South Easton, Mass. 02375

[21] Appl. No.: 996,103

[22] Filed: Dec. 22, 1997

Related U.S. Application Data

[60] Provisional application No. 60/034,304, Dec. 23, 1996.

[51] Int. Cl. [6] ..... F24D 19/06

[52] U.S. Cl. ..... 165/55; 118/504; 454/287

[58] Field of Search ..... 165/55, 182; 118/504; 454/287; 138/115

[56] References Cited

U.S. PATENT DOCUMENTS

| | | | |
|---|---|---|---|
| D. 338,061 | 8/1993 | Reed et al. . | |
| D. 338,264 | 8/1993 | Reed et al. . | |
| 2,731,903 | 1/1956 | Newton et al. | 165/55 X |
| 2,774,574 | 12/1956 | Patterson | 165/55 |
| 2,833,905 | 5/1958 | Kenny | 165/55 X |
| 3,398,786 | 8/1968 | McNabney | 165/55 |
| 3,422,798 | 1/1969 | Pine . | |
| 3,448,795 | 6/1969 | McNabney | 165/55 |
| 3,768,549 | 10/1973 | Goodie | 165/55 |
| 3,786,171 | 1/1974 | Shira | 138/115 X |
| 4,258,654 | 3/1981 | Ivankovich | 118/504 |
| 4,280,444 | 7/1981 | Jones | 118/504 |
| 5,181,884 | 1/1993 | Ducharme . | |
| 5,654,074 | 8/1997 | Smith | 118/504 X |

FOREIGN PATENT DOCUMENTS

| | | | |
|---|---|---|---|
| 143991 | 2/1954 | Sweden | 165/55 |

*Primary Examiner*—Leonard R. Leo
*Attorney, Agent, or Firm*—John A. Haug

[57] ABSTRACT

A unitary cover (32,32') for placement over a baseboard heater is shown having an offset portion (40) with a series of spaced apertures (42) for convection and a front panel with a J-shaped section (45,46,48) at the bottom thereof which cooperates with a tab (36) formed on a top platform (34) for snapping on to a baseboard heater housing. According to one embodiment the cover is adaptable to different sized baseboard heater housings by removable portions of upper and lower J-shaped sections (46) or the entire J-shaped section (48). Further, individual short portions of the J-shaped bights and short legs are removable to accommodate brackets, trim accessories and the like. A modified cover (32") has an additional tab (37) which cooperates with the tab (36) formed at the rear of platform (34") for snapping engagement with the top portion of the baseboard heater housing. According to another embodiment the cover (32'") has a plurality of downwardly extending front panel continuation sections (50) joined to the front panel and to each other by a rearwardly offset portion to facilitate adjustment by severing of one or more continuation sections. A lip (**36*a'"***) extends beyond the rear end of the top platform to provide a snug fit eliminating any crevice for ingress of crumbs, liquid and the like.

16 Claims, 5 Drawing Sheets

HEATER COVER APPARATUS

RELATED APPLICATIONS

This application claims the benefit of U.S. Provisional Application No. 60/034,304, filed Dec. 23, 1996.

FIELD OF THE INVENTION

This invention relates generally to residential and commercial baseboard heaters and more particularly to apparatus for covering such heaters.

BACKGROUND OF THE INVENTION

Baseboard heaters typically comprise an elongated heating element such as a hot water tube, supported by brackets mounted on a wall of a structure. The heating element and associated heat exchange fins are enclosed with a metallic housing. A typical housing has a back panel attached to a wall of the building and has an integral top portion extending over the heating element. A front panel is mounted to brackets leaving a laterally extending opening between the top portion and the front panel for reception of a movably mounted damper. Suitable end caps, corner pieces, splice plates and the like are used to complete the baseboard heater assembly.

Over time the finish on the heater assembly housings frequently becomes mottled and unsightly particularly when the assemblies are located in bathrooms near showers or toilets subject to wetting by water, urine and the like or in kitchens and dining areas where table spills and spatter occur.

SUMMARY OF THE INVENTION

It is an object of the present invention to provide apparatus to overcome the above noted prior art problems.

Briefly stated, an elongated heater cover, preferably a unitary member of a thermoplastic plastic material such as polyvinylchloride, polypropylene, acrylonitrile-butadiene-styrene, Nylon or polystyrene, made in accordance with one embodiment of the invention has a top platform with a downwardly extending attachment tab adapted to be received behind the top portion of the baseboard heater housing. According to an optional preferred feature of the invention a lip is formed in the top surface of the platform which extends over the radius formed by the tab to effectively extend the platform surface to the wall behind the baseboard heater in the installed position. A curved portion extends from the front of the platform down to an offset portion which extends a selected distance toward the rear joining a front panel. A series of laterally spaced slots or apertures are formed in the offset portion to allow air convection. A rearwardly facing J-shaped section is formed in the bottom of the front panel with the front panel of the housing received in the bight of the J-shaped section. The member is snapped onto a baseboard heater housing by means of the J-shaped section on the bottom and the tab on the platform for a permanent or temporary installation, as desired.

According to a modified embodiment the member is provided with an additional J-shaped section to make the cover adaptable for different sized baseboard heater housings. Weakened, laterally extending boundaries are formed, preferably in the rear surface of the member, to remove either the bight and short leg of the upper J-shaped section or the entire lower J-shaped section. The J-shaped sections are also divided into short portions by weakened boundaries in the bights and short legs extending from a laterally extending boundary so that individual bights and short legs can be removed to accommodate brackets, trim and the like. The J-shaped sections are preferably dimensioned to receive any of a variety of baseboard heater housings.

According to another modified embodiment, a simplified member particularly useful as a temporary paint shield or the like is formed with first and second tabs extending downwardly from the platform to snap onto the top portion of a housing and a downwardly extending front panel.

In another modified embodiment, the offset portion extends rearwardly at a downwardly inclined angle and is formed with vent slots extending at an inclined angle relative to the vertical direction. A lip is formed extending rearwardly beyond the downwardly extending attachment tab to ensure a snug fit for the heater cover relative to both the wall surface behind the baseboard heater and the baseboard heater unit itself. A plurality of front panel continuation sections are provided with rearwardly offset demarcation surfaces useful in adjusting the height of the heater cover while still providing a pleasing appearance.

Additional objects, advantages and features of the novel and improved heater cover system of the invention will be set forth in part in the description which follows and in part will be obvious from the description.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. Dimensions may have been altered for purposes of illustration. In the drawings.

DETAILED DESCRIPTION OF PREFERRED EMBODIMENTS

Figure 1:
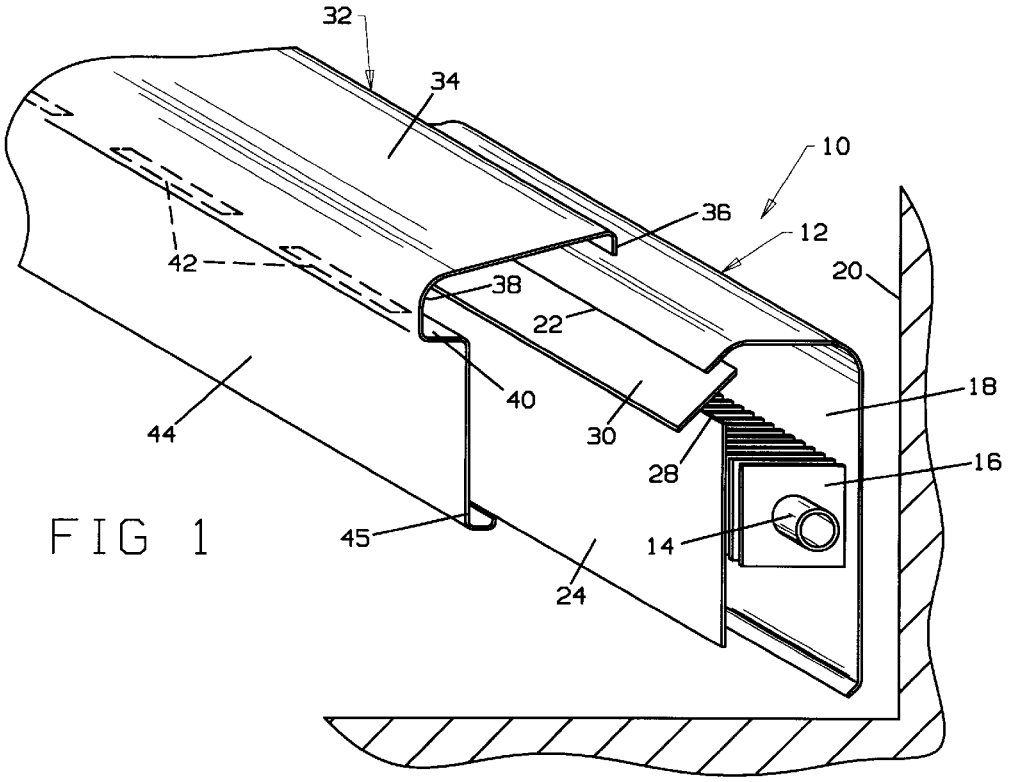
FIG. 1 is a broken away perspective view looking down on a typical baseboard heater assembly with a heater cover made in accordance with the invention about to be snapped onto the heater assembly housing.

With reference to FIG. 1, a baseboard heater assembly 10 is shown having a housing 12 enclosing a heating element in the form of a hot water tube 14 and associated heat transfer fins 16. Housing 12 comprises a rear panel 18 which is generally attached to a building wall 20 in any conventional manner (not shown). Rear panel 18 of a conventional housing as shown extends over the top to a front distal end at 22. A front panel 24 is mounted on brackets (not shown) and extends generally from a location a short distance above floor 26 to a location 28 spaced from distal end 22 leaving a space for reception of a movably mounted damper vane 30.

Figure 1A:
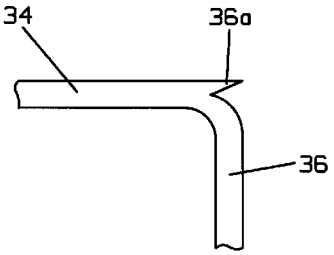
FIG. 1*a* is a broken away side view of a modified preferred feature of tab 36 of FIG. 1.
Figure 2:
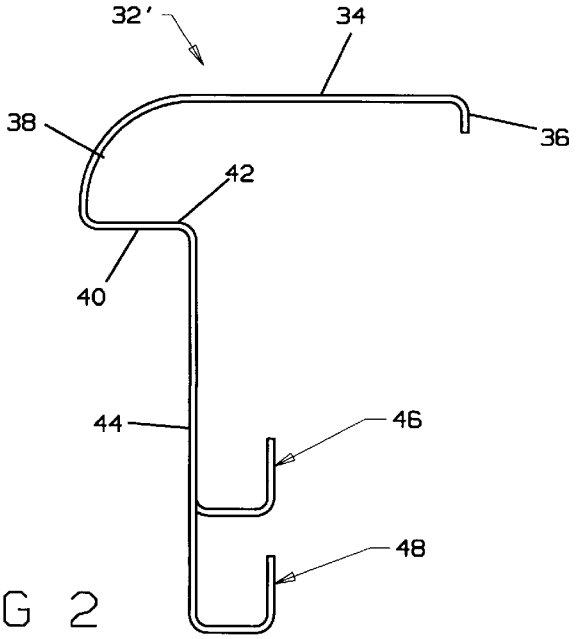
FIG. 2 is a side elevational view of a modification of the FIG. 1 heater cover embodiment.
Figure 3:
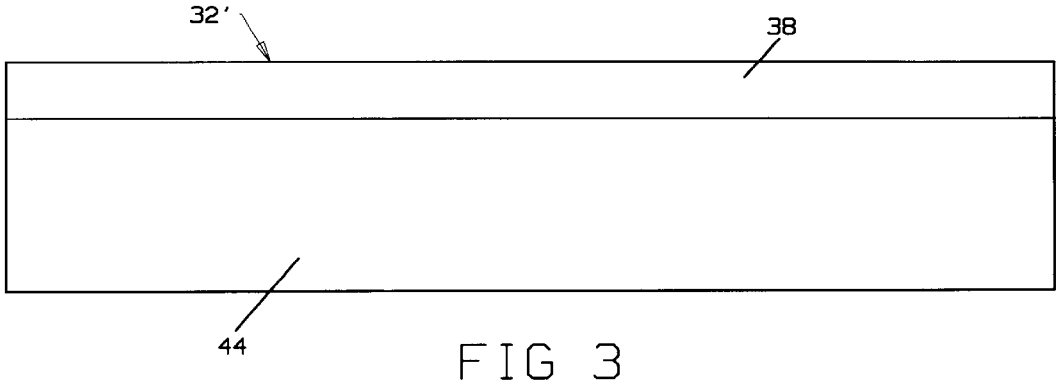
FIG. 3 is a front elevational view of the FIG. 2 heater cover.
Figure 4:
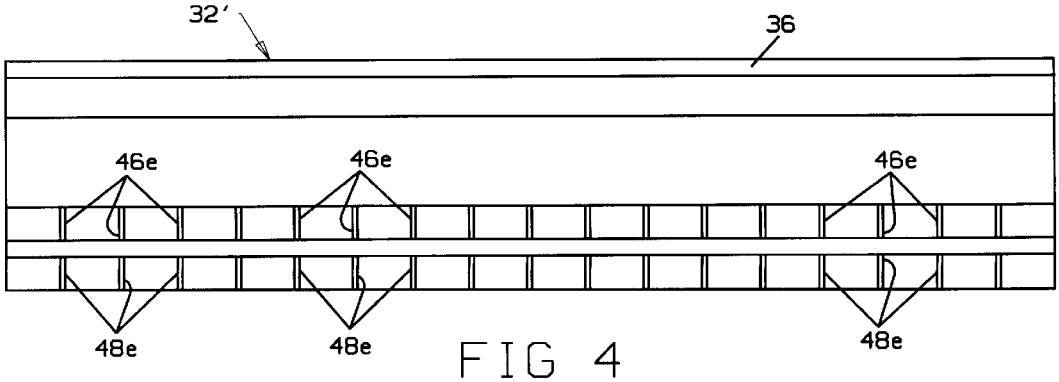
FIG. 4 is a rear elevational view of the FIG. 2 heater cover.
Figure 5:
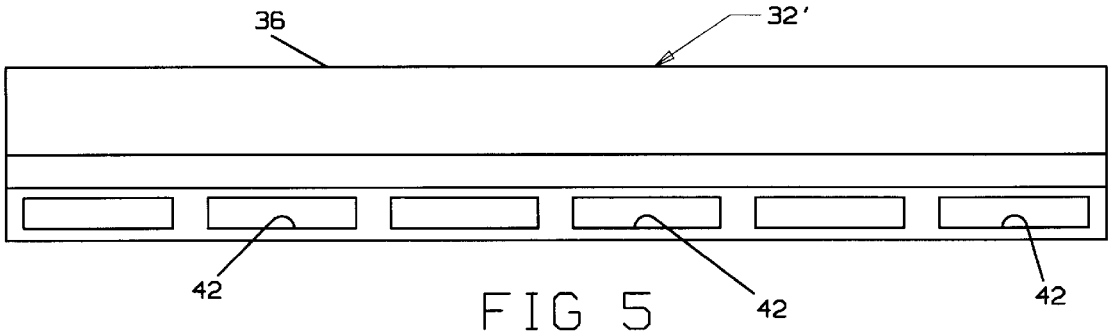
FIG. 5 is a bottom view of the FIG. 2 heater cover.

In accordance with the invention, an elongated, unitary heater cover 32, preferably formed of any suitable thermoplastic material, such as polyvinylchloride (PVC), polypropelene, acrylonitrile-butadiene-styrene, Nylon, polystyrene or the like for extruding,thermoforming or injection molding of a selected length, for example 42 inches, has a top portion or platform 34 formed with a downwardly, laterally extending attachment tab 36 at the rear of platform 34 and a radiused top front portion 38 connected to a rearwardly extending offset portion 40 having a series of laterally spaced apertures or slots 42. Extending downwardly from the rear of offset portion 40 is a front panel 44 which has a generally J-shaped bottom section 45. According to an optional preferred feature of the invention, as seen in FIG. 1*a,* a laterally extending lip 36*a* is formed extending rearwardly beyond top platform 34 over the radius formed between platform 34 and tab 36 so that lip 36*a* will engage wall 20 when cover 32 is snapped in place thereby forming a continuous surface of the platform to the wall surface eliminating any crevice for crumbs, liquid and the like to collect.

Heater cover 32 is aligned with housing 12 and snapped onto the housing with tab 36 received behind the top portion of rear panel 18 and the bottom of front panel 24 received within the bight of J-shaped section 45. The cover provides an attractive surface of any selected color, either smooth or embossed as desired, and can be used as a permanent installation or merely as a temporary paint shield, if desired. Apertures 42, undetectable from above, allow heated air to flow into the room in a conventional manner.

Figure 6:
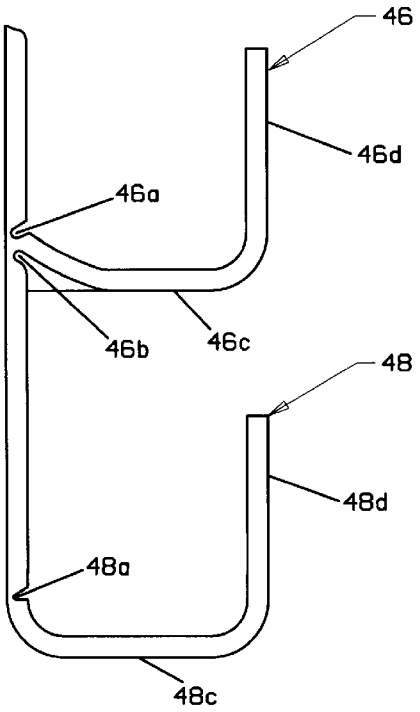
FIG. 6 is an enlarged portion of FIG. 2.
Figure 7:
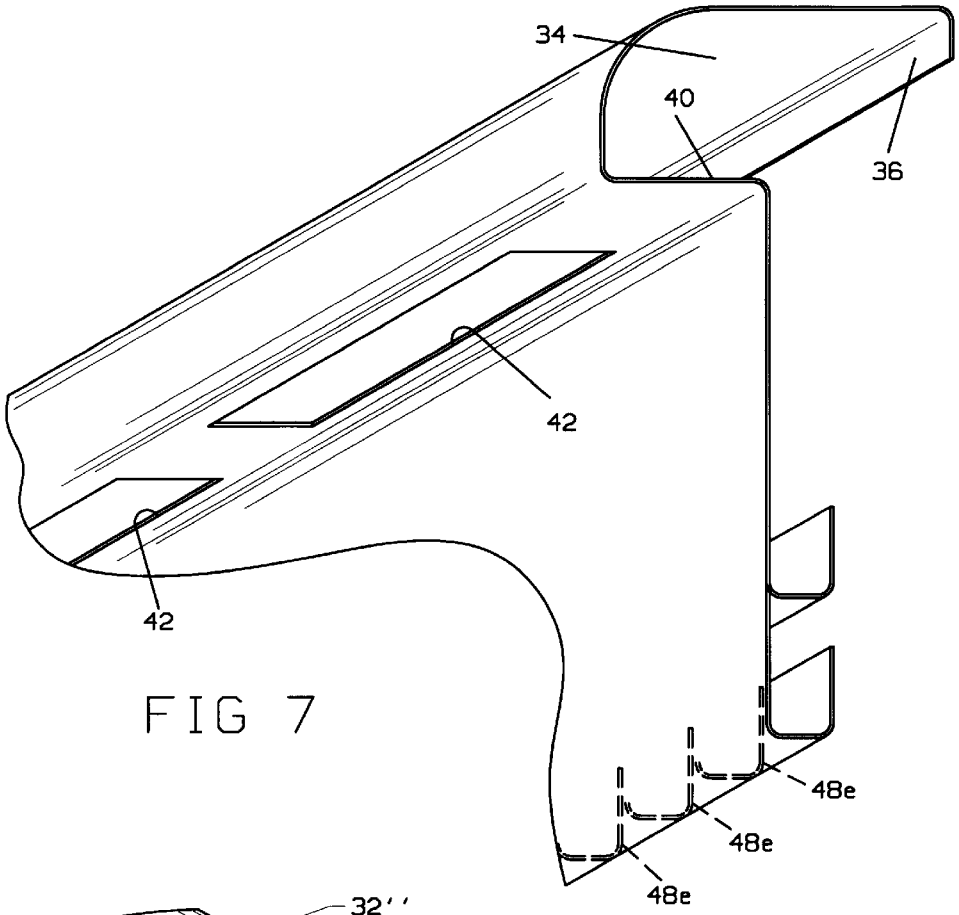
FIG. 7 is a broken away perspective view looking up at the FIG. 2 heater cover.

With reference to FIGS. 2–6, a modified embodiment comprises a cover 32' having a top platform 34, tab 36, radiused top front portion 38, offset portion 40 and front panel 44 as in the FIG. 1 embodiment. It can also include lip 36*a,* if desired. The lower portion of front panel 44 in the FIGS. 2–6 embodiment is formed with first and second J-sections 46,48 respectively. With reference particularly to FIG. 6, laterally extending weakened boundaries or score depressions 46*a,* 46*b,* 48*a* are formed in cover 32' to facilitate breaking or cutting away all or a portion of the J-sections from the cover to provide a customized fit. In instances where the cover is to be used with one standard type of baseboard assembly having a first height suitable for use with J-section 46, the entire length of J-section 48 can be removed at score depression 46*b*. On the other hand, if the cover is to be used with another standard type of baseboard heater assembly having a second height suitable for use with J-section 48 then bight 46*c* and leg 46*d* can be removed at the weakened boundary between depressions 46*a,* 46*b*.

Spaced apart first and second series of weakened score depressions or boundaries 46*e,* 48*e* are formed in bights 46*c,* 48*c* and short or rear legs 46*d,* 48*d,* respectively, of the J-shaped sections so that individual bight and short leg portions can be removed to accommodate a bracket or the like wherever required along the length of the cover. In practice, it has been found that spacing of approximately 2 inches between adjacent score depression boundaries 46*e,* 48*e* is suitable.

Figure 8:
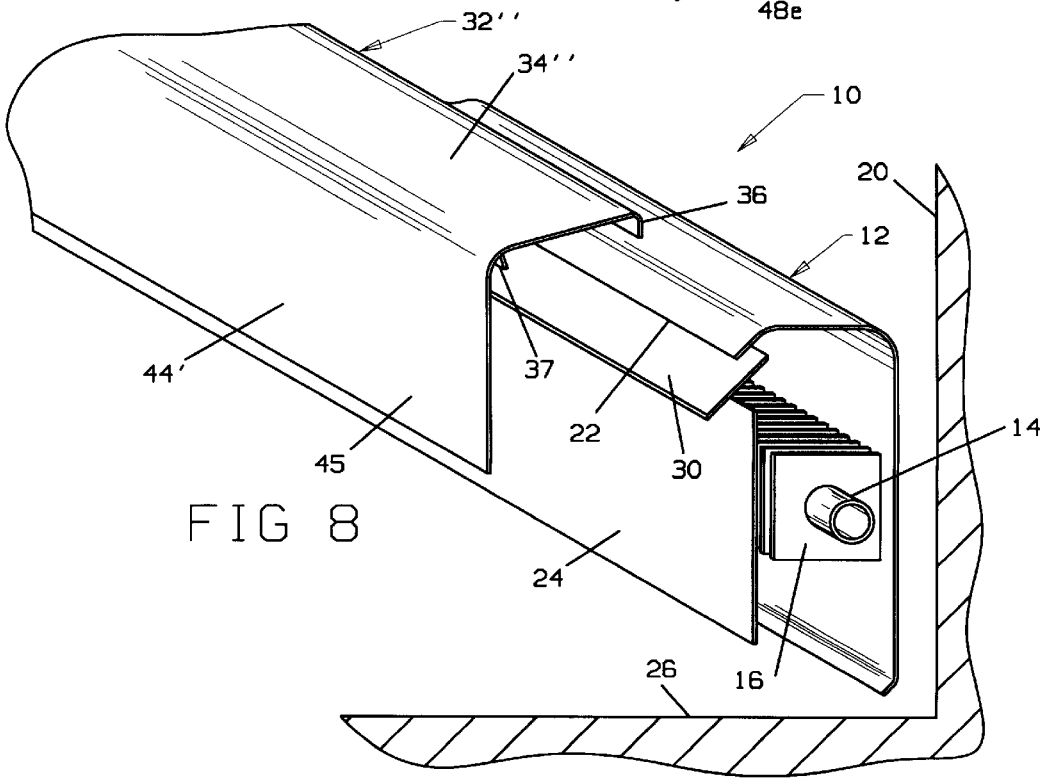
FIG. 8 is a perspective view similar to FIG. 1 of another modified embodiment of the invention.

With reference to FIG. 8, a modified cover 32" comprises an elongated member, preferably of suitable extrudable plastic material, such as polypropylene, or the like, having a top platform 34" with a downwardly extending tab 36, as in the previous embodiments, and a second, spaced apart, tab 37 on the lower surface of platform 34" extending toward the rear thereof adapted to snap over end 22 of the heater housing. Front panel 44" extends downwardly to a straight distal end 45. Cover 32" is particularly useful for temporarily placing over baseboard heater assembly housings when painting, papering or the like is being conducted to thereby provide a protective shield preventing paint drippings, glue or the like from reaching the housings.

Figure 9:
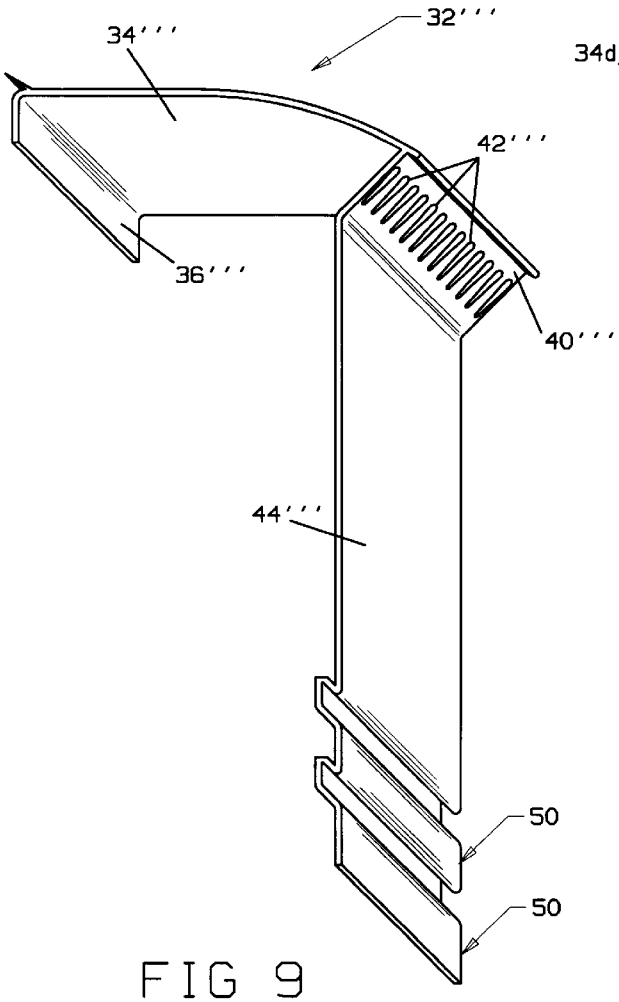
FIG. 9 is a perspective view of yet another modified embodiment of the invention.
Figure 10:
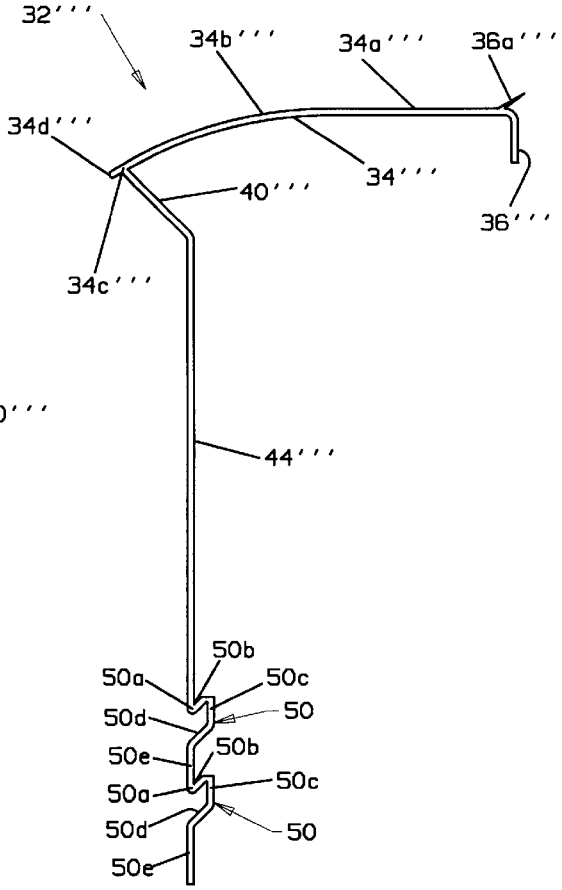
FIG. 10 is a side elevational view of the FIG. 9 heater cover.
Figure 10A:
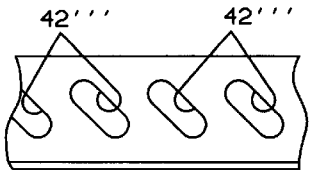
FIG. 10*a* is a broken away, enlarged view of the offset portion of the FIGS. 9,10 heater cover looking in a direction perpendicular to the angled front surface thereof.

Another modified embodiment of the heater cover is shown in FIGS. 9 and 10, along with broken away, enlarged views 10*a,* 10*b*. Heater cover 32'" made in accordance with this embodiment comprises an elongated extruded member of suitable material such as PVC of any selected length, as in the previously described embodiments, and has a top portion of platform 34'" formed with a downwardly, laterally extending tab 36'" at the rear of the platform. Platform 34'" is preferably formed with a first flat, horizontal flat portion 34*a'"*, as seen in FIG. 10 extending from the rear of the platform toward the front to a second curved portion 34*b'"* which extends to the front of cover 32'". Offset portion 40'" is a flat portion which extends at an angle inclined rearwardly from a location 34*c'"* just inboard, or rearwardly, of the front of platform 34'" and forms an angle with front panel 44'" of approximately 45 degrees. Portion 34*d'"*, which projects forwardly from offset portion 40'" serves as a drip edge to prevent liquids which may be spilled onto platform 34'" from running onto offset portion 40'" as well as front panel 44'". A plurality of laterally spaced elongated apertures or slots 42'" are formed in the offset portion with their length preferably extending at an angle of approximately 45 degrees with a horizontal direction to enhance air circulation (see FIG. 10*a*).

A plurality of laterally extending, front panel continuation sections 50 are formed at the bottom portion of front panel 44'". As best seen in FIG. 10, sections 50 are each formed with a relatively sharp reverse bend at 50*a* having a smooth, rounded outer surface, to extend for a short length 50*b* back toward the top portion and then downwardly at 50*c* lying in a second plane parallel to a first plane in which front panel 44'" lies and then at 50*d* back to the first plane at any suitable angle, such as the same angle used for length 50*b*. The intersection of portions 50*b* and 50*c* may be formed with a relatively sharp angle to create a weakened boundary for a purpose to be discussed below. A downwardly extending continuation 50*e* of a selected length extends from length 50*d*. This provides for a pleasing appearance while at the same time provides means for adjusting the overall height of the heater cover to customize its fit to different standard baseboard heater assembly housings. That is, one or more sections 50 can be removed, as by flexing and breaking at the weakened intersection of the appropriate lengths 50*b,*50*c,* leaving the severed edge, which could be somewhat jagged, hidden from view from a cosmetic perspective as well as away from accidental contact with an individual's toes or fingers from a safety aspect. While two sections 50 are shown it will be understood that fewer or more sections can be provided, if desired. It will be understood that suitable cutting means can also be employed, if desired, such as a saw, scissors or the like.

Heater cover 32'" is provided with a lip 36'" which preferably extends upwardly at an inclined angle from flat portion 34*a'"* and from a location slightly forward of tab 36'"

Figure 10B:
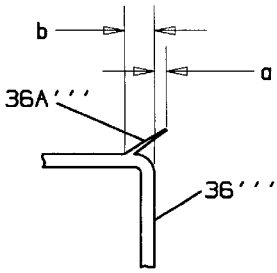
FIG. 10*b* is a broken away, enlarged side elevational view of the rear portion of the FIG. 10 heater cover.

(dimension "a" in FIG. 10*b*). The lip extends rearwardly beyond tab 36''' (dimension "b") with respect to a vertical plane. This feature ensures that the distal free end of lip 36*a*''' will be biased into engagement with the wall surface of the building even if tab 36''' is not directly in engagement with the wall surface. Further, the lip serves to provide a snug fit of the heater cover to the heating assembly housing.

Although the invention has been described with regard to specific preferred embodiments thereof, variations and modifications will become apparent to those skilled in the art. It is therefore the intention that the appended claims be interpreted as broadly as possible in view of the prior art to include all such variations and modifications.

What is claimed:

1. Heater cover apparatus covering a baseboard heater assembly housing comprising an elongated unitary member having a front and a rear portion extending between two opposite sides and having a top platform, a downwardly extending tab formed at a rear portion of the platform, an offset portion extending from the front portion of the member and extending toward the rear portion, a generally flat front panel in the front portion of the member extending downwardly from the rear of the offset portion and having a first generally J-shaped section having a bight extending away from the front panel toward the rear and having a rear leg extending upwardly a selected distance and a plurality of spaced apart apertures formed in the offset portion.

2. Heater cover apparatus according to claim 1 in which the member is formed of thermoplastic material.

3. Heater cover apparatus according to claim 1 in which the member is formed of material selected from the group consisting of polyvinylchloride, polypropelene, acrylonitrile-butadiene-styrene, Nylon and polystyrene.

4. Heater cover apparatus according to claim 1 in which the platform has a generally flat surface and a radiused portion is formed between the platform and the tab and further comprising a lip extending from the platform toward the rear over the radiused portion forming a continuation of the platform surface.

5. Heater cover apparatus according to claim 1 in which a smooth curved surface extends from the platform to the front portion of the member.

6. Heater cover apparatus according to claim 1 further comprising a second generally J-shaped section integrally attached to the first J-shaped section forming a continuation of the front panel, the second J-shaped section having a bight extending toward the rear and a weakened, laterally extending boundary is formed between the front panel and the bight of the first J-shaped section and a weakened, laterally extending boundary is formed in the front panel between the first and second J-shaped sections.

7. Heater cover apparatus according to claim 6 in which the J-shaped sections and the front panel have front and back surfaces and the respective weakened, laterally extending boundaries are formed in the back surfaces thereof.

8. Heater cover apparatus according to claim 6 in which the bight of each of the first and second J-shaped sections is generally flat and extends approximately one inch toward the rear.

9. Heater cover apparatus according to claim 8 in which each J-shaped section has a rear leg extending upwardly approximately one inch from the rear of the respective bight.

10. Heater cover apparatus according to claim 6 in which each of the first and second a-shaped sections has a rear leg and the first and second a-shaped sections are divided into a plurality of short laterally extending portions each defined by a weakened boundary in the rear leg and bight extending from a free end at the rear leg to a respective laterally extending boundary.

11. Heater cover apparatus for covering baseboard heater assembly housings comprising an elongated unitary member extending between two opposite sides and having a top platform extending from front to rear, a generally flat front panel extending downwardly from the front of the platform, a first tab extending downwardly from the rear of the platform and a second tab extending downwardly from a bottom surface of the platform and toward the rear thereof and spaced from the first tab a distance selected to snap onto a top portion of the baseboard heater assembly housings.

12. Heater cover apparatus covering a baseboard heater assembly housing comprising an elongated unitary member having a front and a rear portion extending between two opposite sides and having a top platform, a downwardly extending tab formed at a rear portion of the platform, an offset portion extending from the front portion of the member and extending toward the rear portion, a generally flat front panel in the front portion of the member extending downwardly from the rear of the offset portion to a bottom end and a lip extending rearwardly from the top platform in a direction going from front to rear beyond the downwardly extending tab.

13. Heater cover apparatus according to claim 12 in which the top platform has a rear end and the lip is joined to the top platform adjacent to but spaced from the rear end.

14. Heater cover apparatus according to claim 12 in which the front panel lies in a first plane and further comprising a front panel continuation section, the front panel continuation section being integrally attached to the front panel by an upwardly and rearwardly extending length joined to a downwardly extending length which lies in a second plane parallel to and spaced to the rear of the first plane and joined to an additional downwardly extending length which lies in the first plane.

15. Heater cover apparatus according to claim 14 in which the additional downwardly extending length is joined to the downwardly extending length which lies in the second plane by a length extending at an inclined angle relative to the first and second planes.

16. A heater cover apparatus according to claim 14 further comprising another front panel continuation section integrally attached to the additional downwardly extending length which lies in the first plane.

* * * * *